United States Patent [19]

Baynes

[11] Patent Number: 4,796,930

[45] Date of Patent: Jan. 10, 1989

[54] CLOSURE LATCH

[75] Inventor: Dennis Baynes, Coventry, England

[73] Assignee: General Motors Corporation, Detroit, Mich.

[21] Appl. No.: 87,028

[22] Filed: Aug. 19, 1987

[51] Int. Cl.[4] ..... E05C 5/04; E05B 15/02

[52] U.S. Cl. ..... 292/58; 292/59; 292/341.15; 292/DIG. 60; 292/DIG.23

[58] Field of Search ..... 292/341.15, 57, 58, 292/59, 60, 61, 213, DIG. 23, DIG. 60, DIG. 14, 32, 341.16, 341.17, 251

[56] References Cited

U.S. PATENT DOCUMENTS

| | | | |
|---|---|---|---|
| 1,068,546 | 7/1913 | Thomas | 292/341.15 |
| 1,696,137 | 12/1928 | Colson | 292/341.15 |
| 1,967,627 | 7/1934 | Riley et al. | 292/341.15 |
| 2,486,003 | 10/1949 | Christensen | 292/59 |
| 2,766,058 | 10/1956 | Garniss | 292/341.15 |
| 2,873,991 | 2/1959 | Larimore et al. | 292/58 |
| 3,080,633 | 3/1963 | Reddy | 24/591 |
| 3,081,078 | 3/1963 | Lohr | 292/58 |
| 3,264,019 | 8/1966 | Houvener et al. | 292/58 |
| 3,298,728 | 1/1967 | Dye | 292/58 |
| 3,671,066 | 6/1972 | Gilmore | 292/341.15 |
| 4,159,138 | 6/1979 | Smith | 292/341.15 |

FOREIGN PATENT DOCUMENTS

| | | | |
|---|---|---|---|
| 858993 | 12/1970 | Canada | 292/58 |
| 338102 | 6/1921 | Fed. Rep. of Germany | 292/59 |
| 657003 | 2/1938 | Fed. Rep. of Germany | 292/341.15 |
| 618026 | 7/1947 | United Kingdom | 292/341.15 |
| 614085 | 12/1948 | United Kingdom | 292/341.15 |
| 1430249 | 3/1976 | United Kingdom | 292/59 |

*Primary Examiner*—Gary L. Smith
*Assistant Examiner*—Eric K. Nicholson
*Attorney, Agent, or Firm*—Herbert Furman

[57] ABSTRACT

A vehicle closure latch includes a latch bolt member which is rotatable through a limited arc between latchable and unlatched positions. The latch bolt member includes circumferentially spaced grooves which receive transversely movable striker members when in latchable position to retain the latch bolt against movement relative to the striker members.

4 Claims, 2 Drawing Sheets

CLOSURE LATCH

This invention relates generally to closure latches and more particularly to closure latches for releasably latching vehicle closure members to vehicle pillar members.

The closure latch of this invention differs from known vehicle closure latches by having a latch bolt member of annular configuration which is mounted on the closure member for limited rotation about its axis between latchable and unlatched positions. The latch bolt member includes at least one pair of circumferentially spaced grooves which receive the edge portions of a pair of movable striker members when the latch bolt member is in latchable position. The striker members are mounted on the pillar member for movement normal to the axis of the latch bolt member. The engagement of the striker members in the grooves of the latch bolt member prevent withdrawal of the latch bolt member relative to the striker members to releasably latch the closure member to the pillar member.

The latch bolt member is resiliently biased to the latchable position. When the striker members are in engagement with the grooves of the latch bolt member and the latch bolt member is rotated to the unlatched position, the striker member move into engagement with the surface of the latch bolt member intermediate the grooves to permit withdrawal of the latch bolt member relative to the striker members and opening movement of the closure member. The striker members are resiliently biased toward each other and are normally located apart a distance slightly less than the diameter of the latch bolt member. When the latch bolt member is in latchable position and moved into engagement with the striker members, the leading end portion of the latch bolt member cams the strlker members apart until the striker members enter into the grooves of the latch bolt member to releasably latch the closure member to the pillar member. The configuration of the grooves of the latch bolt member matches the configuration of the edge portions of the striker members. Such grooves are located generally normal to the plane of the striker members when the latch bolt member is in latchable position and is inserted between the striker members.

The primary feature of this invention is that it provides a closure latch which includes an elongated annular latch bolt member rotatable about its axis between latchable and unlatched position and having a circumferentially spaced pair of grooves which receive transversely movable striker members in the latchable position of the latch bolt member to prevent relative movement therebetween. Another feature is that the latch bolt member is resiliently biased to latchable position and rotates through a limited arc of rotation between latchable and unlatched positions. A further feature is that the striker members are resiliently biased toward each other and are normally located apart a distance less than the diameter of the latch bolt member. Yet another feature is that the latch bolt member has a leading end portion which resiliently cams the striker members apart relative to each other during initial insertion of the latch bolt member relative to the striker members until the striker members move into engagement with the grooves of the latch bolt member.

These and other features of the invention will be apparent from the following description and drawings wherein.

Figure 1:
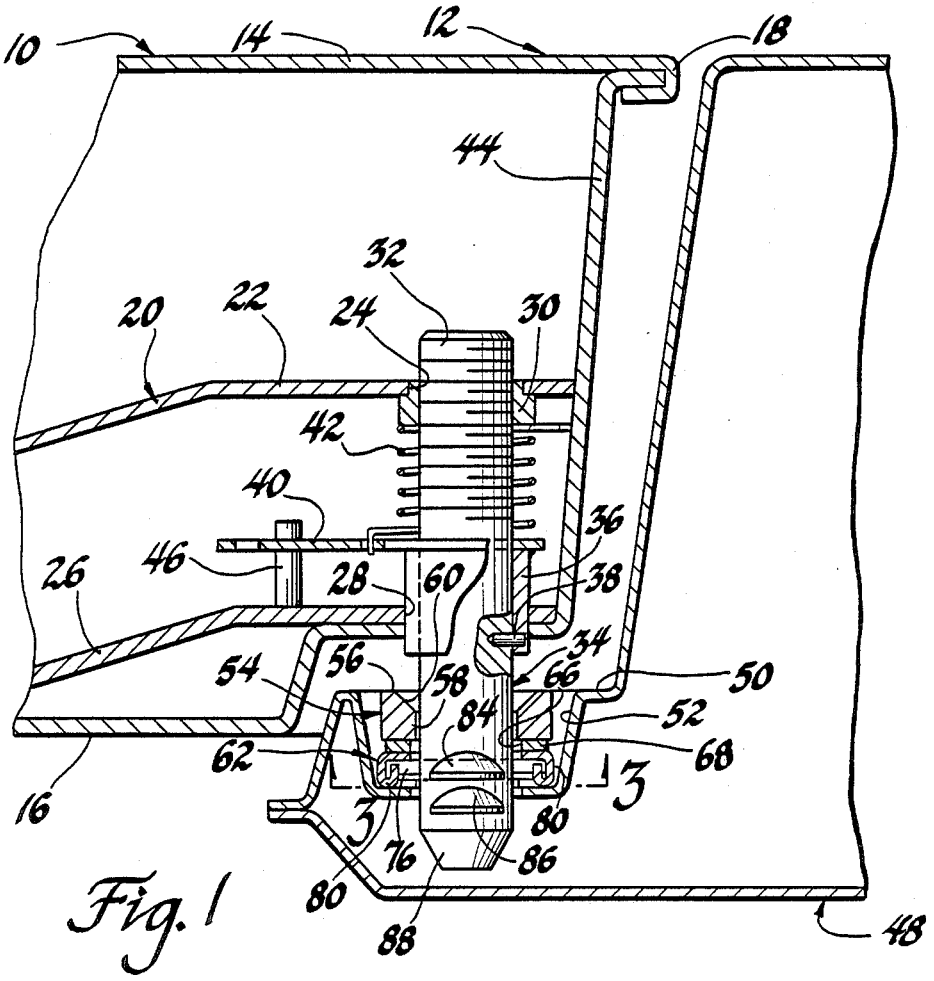
FIG. 1 is a sectional view of a vehicle closure member releasably held in latched position relative to a vehicle pillar member by a closure latch according to this invention.
Figure 2:
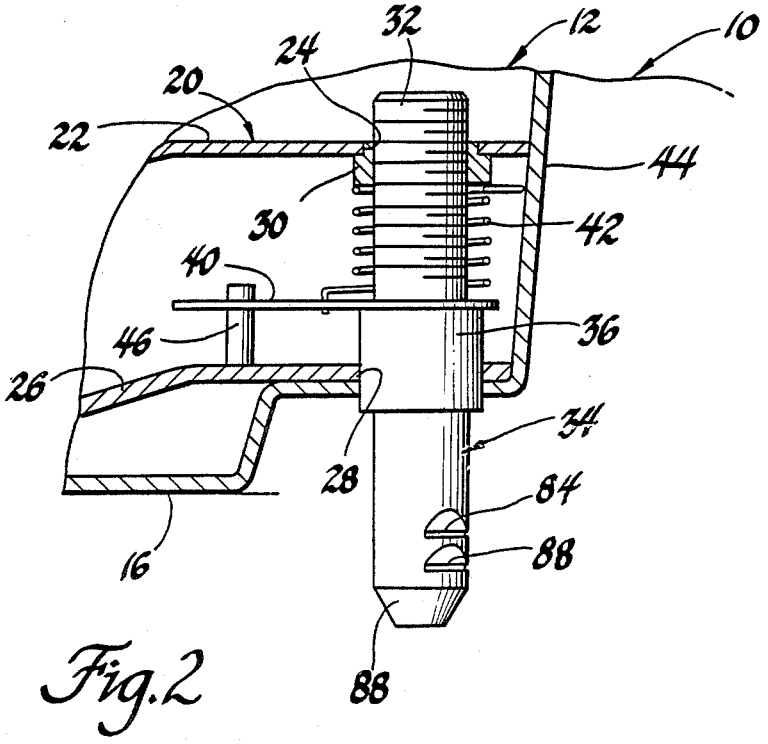
FIG. 2 is a view of a portion of FIG. 1 showing the latch bolt member in unlatched position.

Referring now to FIG. 1 of the drawings, a vehicle designated generally 10 includes a door or closure member 12 which includes a door outer panel 14 and a door inner panel 16 which is hem flanged at 18 to the outer panel. A hollow bar 20 extends trarsversely of door 12. In the embodiment shown, the bar 20 is generally of square cross-section and includes an outer wall 22 having a circular aperture 24 and an inner wall 26 having an axially aligned circular aperture 28.

Figure 3:
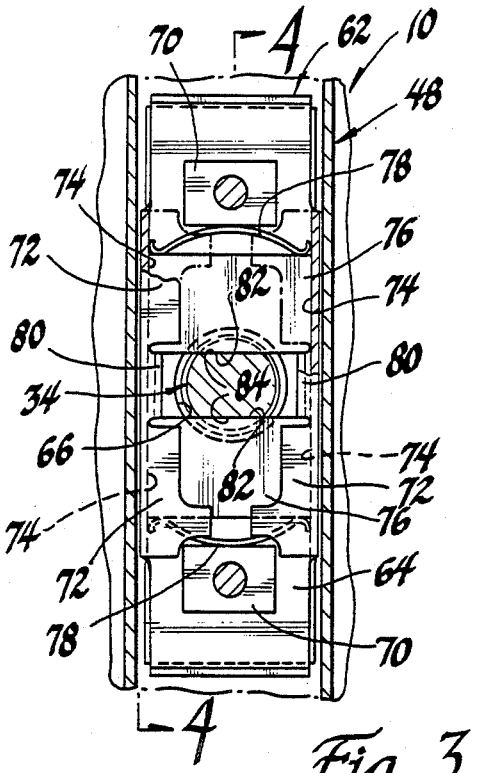
FIG. 3 is a view taken generally along line 3—3 of FIG. 1.
Figure 4:
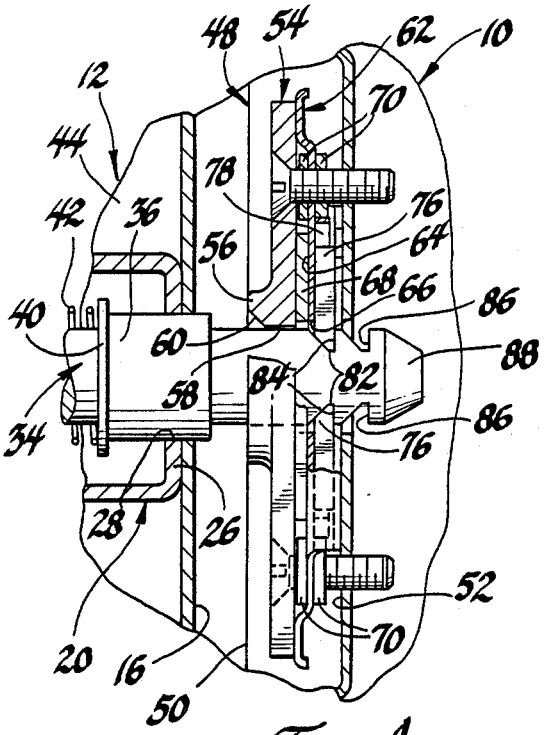
FIG. 4 is a sectional view taken generally along line 4—4 of FIG. 3.
Figure 5:
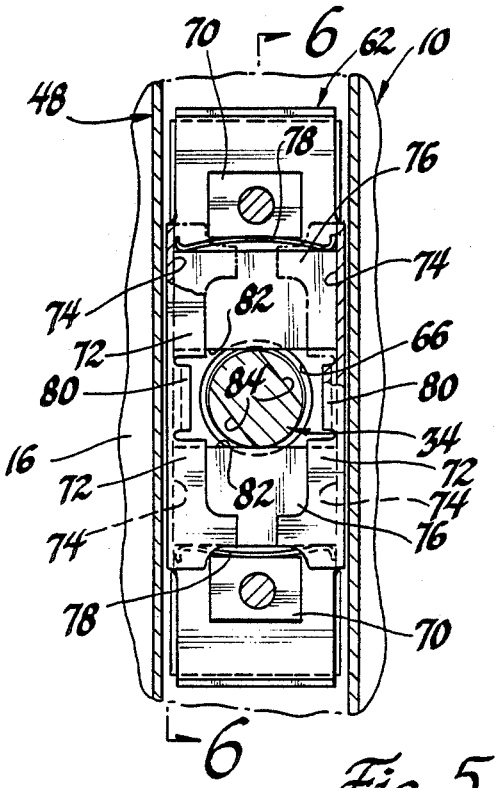
FIG. 5 is a view showing the latch bolt member and striker members in unlatched position relative to each other.
Figure 6:
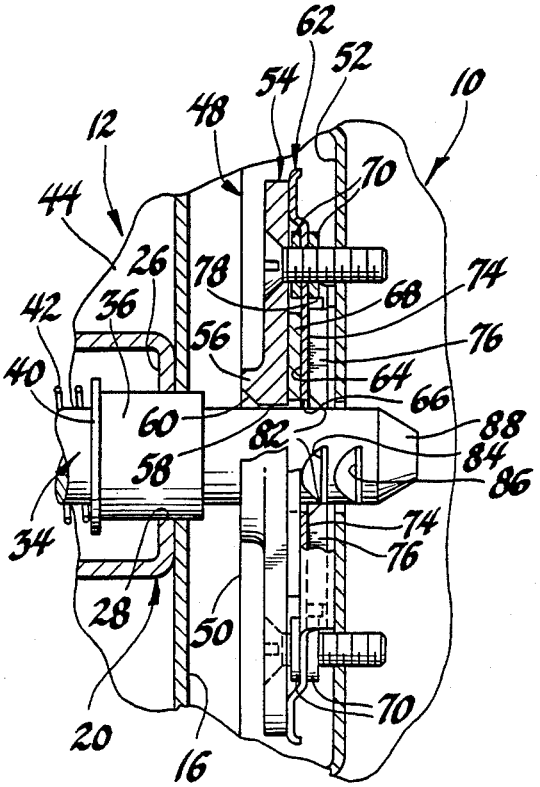
FIG. 6 is a view taken along line 6—6 of FIG. 5.

A shouldered bushing or threaded nut member 30 is staked or otherwise releasably secured within the opening 24. The bushing is internally threaded and receives the threaded inner end 32 of a latch bolt member 34 of circular cross-section. A bushing 36 is pinned at 38, FIG. 1, to the latch bolt member 34 and rotatively received within the opening 28. The bushings 30 and 36 thus rotatively mount the latch bolt member 34 on the door 12. The latch bolt member projects outwardly of the inner panel 16 of the door through an aperture therein axially aligned with aperture 28. An operating leyer 40 is fixed to the bushing 36. A coil torsion spring 42 surrounds the latch bolt member 34. One end of the spring 42 is hooked to the lever 40 and the other end engages the side wall 44 of door 12 to resiliently bias the latch bolt member 34 counterclockwise as viewed in FIGS. 1, 2, 3 and 5. A suitable stop 46 on wall 26 is engaged by the lever 40 under the bias of spring 42 to locate the lever 40 as shown in FIGS. 1, 3 and 4 and normally locate the latch bolt member 34 in its latchable position.

The vehicle 10 further includes a pillar member 48 having a wall 50 provided with a vertically elongated recess 52.

A striker assembly is mounted to the pillar member 48 within recess 52 and includes a cover member 54 having a circular projecting rib 56 defining an opening 58. The outer surface 60 of opening 58 is conical.

A mounting plate 62 has a recessed center portion 64 between the ends thereof which is apertured at 66 coaxial with opening 58. A spacer plate 68 is secured to the outer side of the recessed portion 64 and apertured coaxially with aperture 66. Nuts 70 are welded to the inner and outer sides of the recessed portion 64 at the upper and lower ends thereof.

The mounting plate 62 includes return bent side flanges 72 which cooperate with the inner side of the recessed portion 64 in providing vertical guide channels 74. A pair of like striker members 76 have their side edge portions received in the guide channels 74 for movement toward and apart relative to each other along the inner side of the recessed portion 64. Leaf springs 78 seat between the inside nuts 70 and the upper and lower trailing edges of the striker members 76 to bias the striker members toward each other and into engagement with return bent tabs stop 80 of the mounting plate 62 to normally locate the chamfered leading edge portions 82 of the striker members apart a distance less than the diameter of the latch bolt member 34.

As shown in FIG. 3, when the latch bolt member 34 is in the latchable position, a pair of circumferentially spaced chordal grooves 84 thereof receive the chamfered leading edge portions 82 of the upper and lower striker members. The cross-section of the grooves 84 is the same as that of the edge portion 82 as shown in FIG. 4.

When the striker members 76 have their edge portions 82 in engagement with the grooves 84, withdrawal of the latch bolt member 34 relative to the striker members is prevented by the engagement of the leading or planar outer sides of the edge portions 82 with the leading or planar outer sides of grooves 84. Thus, the door 12 is releasably retained in its closed position relative to the pillar member 48 as shown in FIGS. 1, 3 and 4. The closure member 12 is shown in a fully closed position in these figures. If it were located in an intermediate or partially closed position, the striker members 76 would engage in the other set of grooves 86 of the latch bolt member 34. These grooves are the same as the grooves 84 and the striker members cooperate therewith in the same manner.

When it is desired to open the door 12, the lever 40 is rotated clockwise as viewed in FIGS. 3 and 4 by a suitable inside or outside release mechanism. This rotation of the lever rotates the latch bolt member 34 in the same direction through a limited arc between its latchable position shown in FIGS. 3 and 4 and its unlatched position shown in FIG. 5. In the unlatched position, the outer surface of the latch bolt member 34 intermediate the grooves 84 engages the edge portions 82 of the striker members 76 so that the latch bolt member 34 can be withdrawn concurrent with opening movement of the door 12. As soon as the latch bolt member 34 has been withdrawn from between the striker members, the lever 40 is released and the spring 42 and stop 46 act to locate the latch bolt member 34 in its latchable position. Springs 78 return the striker members 76 to their position shown in FIGS. 3 and 4.

It will be noted with reference to FIGS. 1 and 4 that the latch bolt member 34 includes a generally frustoconical shaped outer or leading end portion 88. When the door 12 is in open position and is moved toward closed position, the end portion 88 engages the chamfered leading or outer sides of edge portions 82 of the striker members 76 to cam the striker members apart so that the latch bolt member 34 can enter between these members. As soon as the planar leading or outer sides of grooves 86 engage the planar leading or outer sides of the edge portions 82 of the striker members, the door will be releasably held in an intermediate closed position. Upon further closing movement of door 12, the chamfered trailing or inner sides of the striker members 76 cam the striker members apart by engagement with the chamfered trailing or inner sides of grooves 86, the striker members 76 move into engagement with the grooves 84 to hold the door in a fully closed and latched position.

During rotational movement of the latch bolt member 34 between its latchable and unlatched positions, the bolt threads slightly inwardly and outwardly of the bushing 30. Additionally, any adjustment required between the latch bolt member 34 and the striker members 76 can be easily accomplished by releasing the bushing 30 when the latch bolt member 34 is in latched position, rotating the bushing to axially adjust latch bolt member 34 to the desired position, and fixing the bushing 30 in the net, rotative position.

Thus this invention provides an improved closure latch.

The embodiments of the invention in which an exclusive propery or privilege is claimed are defined as follows:

1. A closure latch for releasably latching a vehicle closure to a vehicle pillar comprising, in combination, an elongated cylindrical latch bolt having threaded and non-threaded exterior surface portions and a circumferentially spaced pair of exterior coplanar grooves, means threadably mounting the threaded portion of the latch bolt on the vehicle closure for concurrent rotational and axial movement of the latch bolt relative to the vehicle closure, means releasably securing the threadedly mounting means to the closure, second means mounting the non-threaded portion of the latch bolt on the vehicle closure for concurrent rotational and axial movement relative thereto, means locating the latch bolt in a predetermined rotational position relative to the vehicle closure and permitting axial movement of the latch bolt independently of the locating means while in such rotational position, a pair of striker members, each having a free edge portion shaped for mating with a respective latch bolt groove, means mounting the striker members on the vehicle pillar for movement toward each other and into latching engagement with a respective latch bolt groove to block withdrawl of the latch bolt from between the striker members, release of the releasable securing means from the closure and subsequent rotational movement of the threadedly mounting means relative to the latch bolt member when the latch bolt member is in the predetermined position adjusting the position of the latch bolt grooves relative to the free edge portions of the striker members to provide matching engagement of such free edge portions of the striker members with their respective latch bolt grooves.

2. A closure latch for releasably latching a vehicle closure to a vehicle pillar comprising, in combination, an elongated cylindrical latch bolt having threaded and non-threaded exterior surface portions and a circumferentially spaced pair of exterior coplanar grooves, means threadedly mounting the threaded portion of the latch bolt on the vehicle closure for concurrent rotational and axial movement of the latch bolt relative to the vehicle closure between latchable and unlatched positions, means releasably securing the threadedly mounting means to the vehicle closure, means mounting the non-threaded portion of the latch bolt on the vehicle closure for concurrent rotational and axial movement of the latch bolt between latchable and unlatched positions, operating means secured to the latch bolt for rotating the latch bolt from latchable position to unlatched position, the latch bolt concurrently moving axially as the latch bolt threads relative to the threadedly mounting means, locating means including resilent means operative between the operating means and the vehicle closure for locating the latch bolt in the latchable position and permitting rotational and axial movement of the latch bolt to unlatched position independently of the locating means upon operation of the operating means, a pair of striker members, each having a free edge portion shaped for mating with a respective latch bolt groove, means mounting the striker members on the vehicle pillar for movement toward each other and into latching engagement with a respective latch bolt groove when the latch bolt is in the latchable position to block withdrawal of the latch bolt from between the striker members, release of the releasable securing means from the vehicle closure and subsequent rotational movement of other threadedly mounting means relative to the latch bolt when the latch bolt is in the latchable position adjusting the position of the latch bolt grooves relative to the free edge portion of the striker members to provide matching engagement of such free edge portions of the striker members with their respective latch bolt grooves.

3. A closure latch for releasably latching a vehicle closure to a vehicle pillar comprising, in combination, an elongated cylindrical latch bolt having threaded and non-threaded exterior surface portions and a circumferentially spaced pair of exterior coplanar grooves, means threadedly mounting the threaded portion of the latch bolt on the vehicle closure for concurrent rotational and axial movement of the latch bolt relative to the vehicle closure between latchable and unlatched positions, means releasably securing the threadedly mounting means to the vehicle closure, means mounting the non-threaded portion of the latch bolt on the vehicle closure for concurrent rotational and axial movement of the latch bolt between latchable and unlatched positions, operating means secured to the latch bolt for rotating the latch bolt from latchable position to unlatched position, the latch bolt concurrently moving axially as the latch bolt threads relative to the threadedly mounting means, locating means including coil spring means surrounding the latch bolt and having one end thereof slidably engaging the vehicle closure and the other end thereof operatively connected to the operating means for locating the latch bolt in the latchable position and permitting rotational and axial movement of the latch bolt to unlatched position independently of the locating means upon operation of the operating means, a pair of striker members, each having a free edge portion shaped for mating with a respective latch bolt groove, means mounting the striker members on the vehicle pillar for movement toward each other and into latching engagement with a respective latch bolt groove when the latch bolt is in the latchable position to block withdrawal of the latch bolt from between the striker members, release of the releasable securing means from the vehicle closure and subsequent rotational movement of other threadedly mounting means relative to the latch bolt when the latch bolt is in the latchable position adjusting the position of the latch bolt grooves relative to the free edge portions of the striker members to provide matching engagement or such free edge portions of the striker members with their respective latch bolt grooves.

4. A closure latch for releasably latching a vehicle closure to a vehicle pillar comprising, in combination, an elongated cylindrical latch bolt having threaded and non-threaded exterior surface portions and a circumferentially spaced pair of exterior coplanar grooves, means threadedly mounting the threaded portion of the latch bolt on the vehicle closure for concurrent rotational and axial movement of the latch bolt relative to the vehicle closure between latchable and unlatched positions, means releasably securing the threadedly mounting means to the vehicle closure, means mounting the non-threaded portion of the latch bolt on the vehicle closure for concurrent rotational and axial movement of the latch bolt between latchable and unlatched positions, operating means secured to the latch bolt for rotating the latch bolt from latchable position to unlatched position, the latch bolt concurrently moving axially as the latch bolt threads relative to the threadedly mounting means, locating means including resilient means operative between the operating means and the vehicle closure for locating the latch bolt in the latchable position and permitting rotational and axial movement of the latch bolt to unlatched position independently of the locating means upon operation of the operating means, a pair of striker members, each having a free end edge portion shaped for mating with a respective latch bolt groove and side edge portions, guide means mounting the side edge portions of the striker members on the vehicle pillar for movement toward each other and into latching engagement with a respective latch bolt groove when the latch bolt is in the latchable position to block withdrawal of the latch bolt from between the striker members, resilient means biasing the striker members toward each other, means locating the striker members relative to each other in the unlatched position of the latch bolt, release of the releasable securing means from the vehicle closure and subsequent rotational movement of other threadedly mounting means relative to the latch bolt when the latch bolt is in the latchable position adjusting the position of the latch bolt grooves relative to the free edge portions of the striker members to provide matching engagement of such free edge portions of the striker members with their respective latch bolt grooves.

* * * * *